US005774152A

United States Patent [19]

Namba et al.

[11] Patent Number: 5,774,152

[45] Date of Patent: Jun. 30, 1998

[54] INK JET RECORDING HEAD AND METHOD MANUFACTURING THEREOF

[75] Inventors: Yumiko Namba; Koji Ikegami, both of Ebina, Japan

[73] Assignee: Fuji Xerox Co., Ltd., Tokyo, Japan

[21] Appl. No.: 631,091

[22] Filed: Apr. 12, 1996

[30] Foreign Application Priority Data

Apr. 25, 1995 [JP] Japan ..... 7-099326

[51] Int. Cl.[6] ..... B41J 2/05

[52] U.S. Cl. ..... 347/65; 29/890.1; 156/60; 156/330; 347/20

[58] Field of Search ..... 347/20, 85, 65, 347/63; 29/890.1; 156/60, 330

[56] References Cited

U.S. PATENT DOCUMENTS

| | | | |
|---|---|---|---|
| 4,725,862 | 2/1988 | Matsuzaki | 347/45 X |
| 4,751,532 | 6/1988 | Fujimura et al. | 347/45 X |
| 4,947,184 | 8/1990 | Moynihan | 347/45 |
| 5,216,446 | 6/1993 | Satoi | 347/65 |
| 5,333,007 | 7/1994 | Kneezel et al. | 347/20 |
| 5,439,956 | 8/1995 | Noguchi | 347/20 X |
| 5,450,111 | 9/1995 | Sato | 347/65 X |
| 5,515,089 | 5/1996 | Herko | 347/63 |

FOREIGN PATENT DOCUMENTS

| | | | |
|---|---|---|---|
| 0 495 678 A2 | 1/1992 | European Pat. Off. | B41J 2/175 |
| 0 611 154 A2 | 2/1994 | European Pat. Off. | B41J 2/135 |
| A-5-147226 | 6/1993 | Japan | B41J 2/165 |
| A-5-293964 | 11/1993 | Japan | B41J 2/05 |
| A-6-8419 | 1/1994 | Japan | B41J 2/01 |
| A-6-134987 | 5/1994 | Japan | B41J 2/045 |
| A-6-210855 | 8/1994 | Japan | B41J 2/05 |
| A-6-344555 | 12/1994 | Japan | B41J 2/045 |

*Primary Examiner*—Joseph W. Hartary
*Attorney, Agent, or Firm*—Oliff & Berridge, PLC

[57] ABSTRACT

A jetting element has a plurality of nozzles, a heating body for jetting ink droplets from the nozzles, and an ink chamber communicating with the nozzles. A manifold is bonded with the jetting element through an adhesive, and has an ink flow path formed therein to supply an ink to the jetting element. After the ink has been charged, the interior of the ink flow path is held at a negative pressure. An adhesive whose gas permeability is smaller than $2.0\times10^{-6}$ $cm^3 \cdot cm/cm^2 \cdot sec \cdot atm$ and whose angle of contact with respect to the ink is 45° or less is used as the adhesive. The bonded portion created by the adhesive has a smooth shape so that air bubbles are hard to adhere to the bonded portion.

8 Claims, 5 Drawing Sheets

FIG. 3
| GAS PERMEABILITY ($cm^3 \cdot cm/cm^2 \cdot sec \cdot atm$) | LEAVE INOPERATIVE FOR A WEEK | LEAVE INOPERATIVE FOR A MONTH |
|---|---|---|
| $2\times10^{-5}$ | 7/10 | 10/10 |
| $2\times10^{-6}$ | 2/10 | 8/10 |
| $2\times10^{-7}$ | 0/10 | 0/10 |
| $2\times10^{-8}$ | 0/10 | 0/10 |
FIG. 4
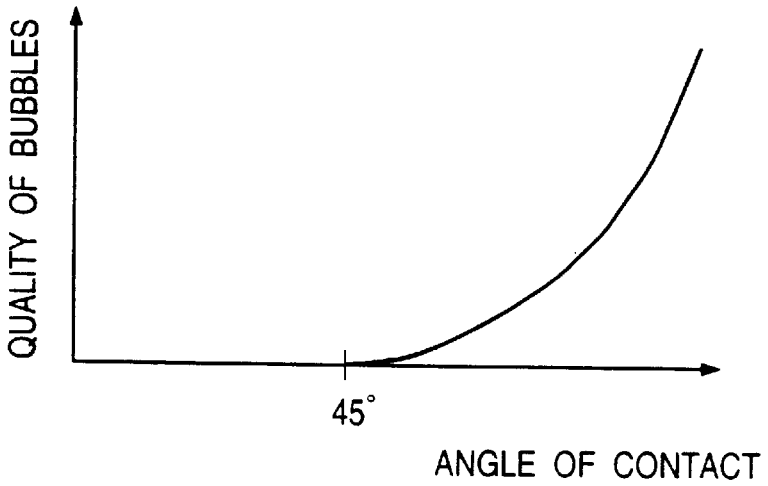
FIG. 5A
PRIOR ART
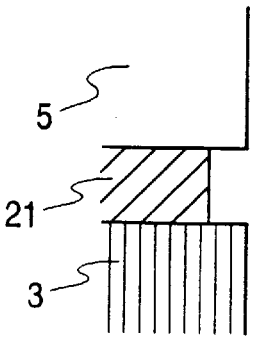
FIG. 5B
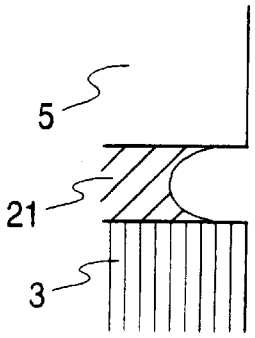

FIG. 6

| SHAPE | LEAVE INOPERATIVE FOR A WEEK | LEAVE INOPERATIVE FOR A MONTH |
|---|---|---|
| a | 2/10 | 8/10 |
| b | 10/10 | 10/10 |

FIG. 7

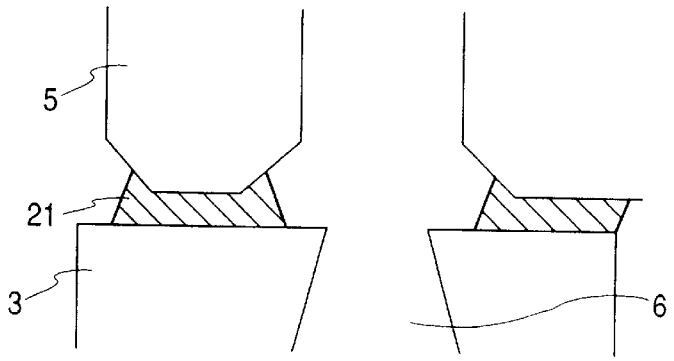

FIG. 8

| GAS PERMEABILITY | ANGLE OF CONTACT | SHAPE | LEAVE INOPERATIVE FOR A DAY | LEAVE INOPERATIVE FOR A WEEK | LEAVE INOPERATIVE FOR A MONTH |
|---|---|---|---|---|---|
| $2\times10^{-5}$ $\left(\frac{cm^3 \cdot cm}{cm^2 \cdot sec \cdot atm}\right)$ | 60° | a | 0/10 | 7/10 | 10/10 |
| | | b | 5/10 | 10/10 | 10/10 |
| | 40° | a | 0/10 | 3/10 | 7/10 |
| | | b | 2/10 | 5/10 | 10/10 |
| $2\times10^{-6}$ $\left(\frac{cm^3 \cdot cm}{cm^2 \cdot sec \cdot atm}\right)$ | 60° | a | 0/10 | 2/10 | 8/10 |
| | | b | 1/10 | 6/10 | 10/10 |
| | 40° | a | 0/10 | 0/10 | 3/10 |
| | | b | 0/10 | 0/10 | 8/10 |

PRIOR ART FIG. 9
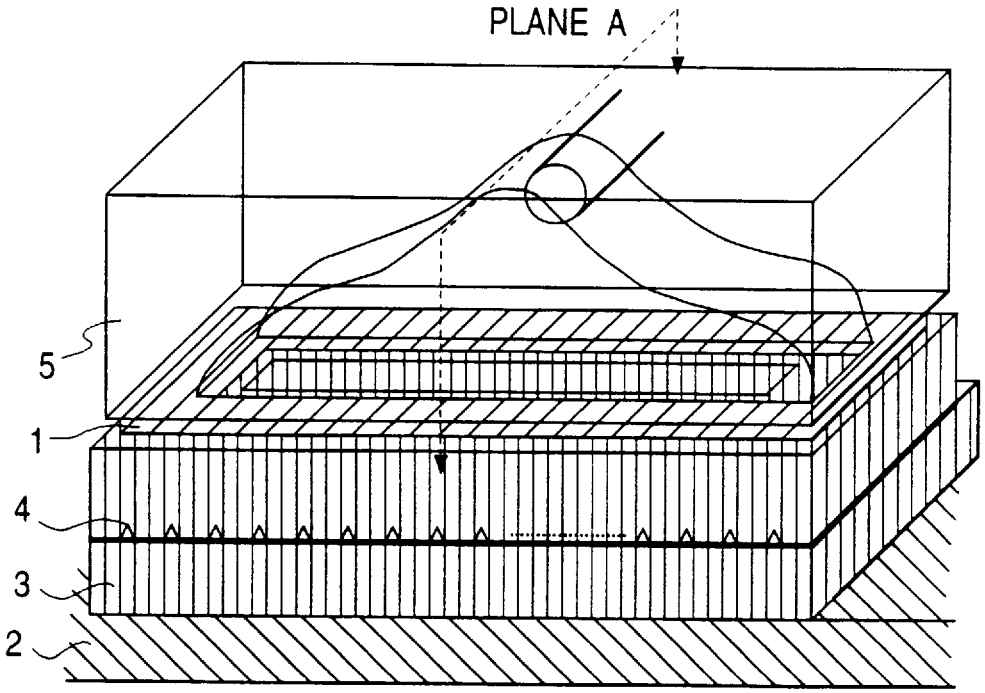
PRIOR ART FIG. 10
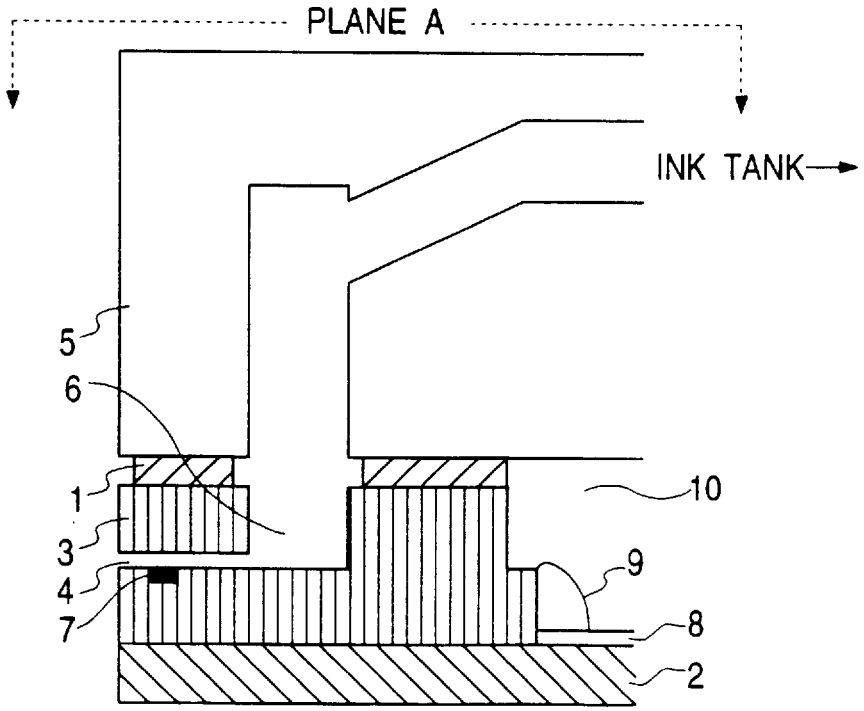

PRIOR ART FIG. 11
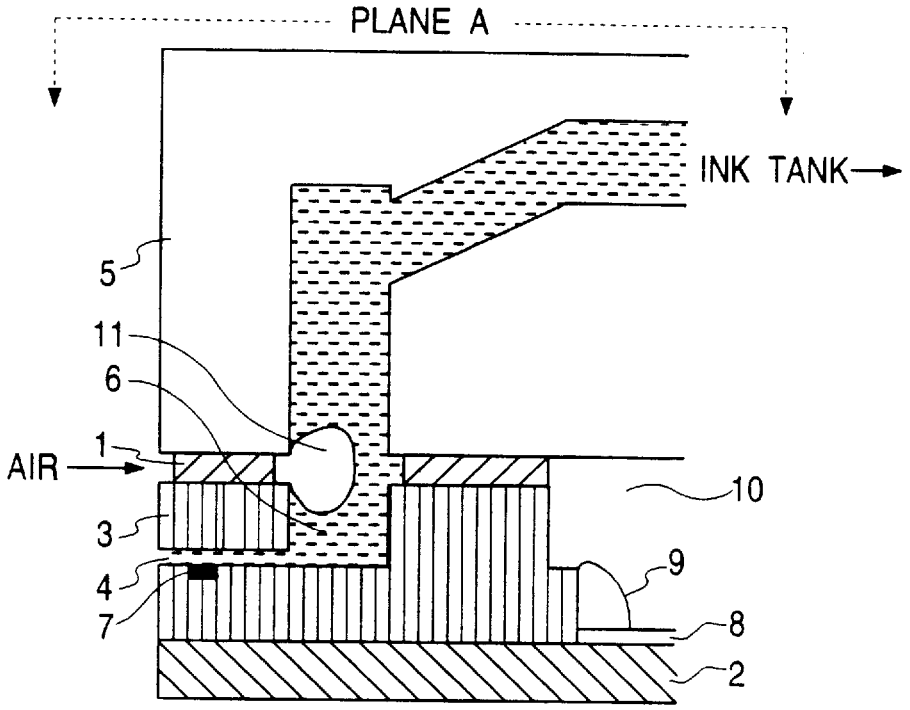
PRIOR ART FIG. 12
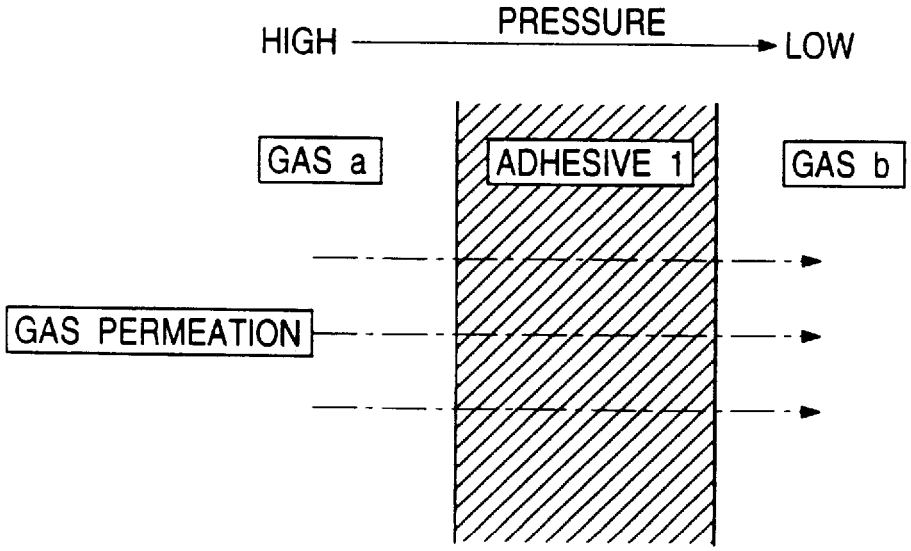

INK JET RECORDING HEAD AND METHOD MANUFACTURING THEREOF

BACKGROUND OF THE INVENTION

The invention relates to an ink jet recording head and a method of manufacturing such ink jet recording head.

Ink jet recording heads record data by introducing ink contained in an ink tank into nozzles, producing air bubbles while causing heat generating bodies arranged in the respective nozzles to generate heat, and then splashing the ink from the nozzles with pressure of the air bubbles produced. A flow path for the ink extending from the ink tank to the nozzles is formed of a plurality of parts. An impermeable flow path is formed so that the ink will not leak from the bonded portions between these parts.

FIG. 9 is a perspective view of an exemplary conventional ink jet recording head in the vicinity of a jetting element and a manifold. FIG. 10 is a sectional view taken along a plane A of the exemplary conventional ink jet recording head. In FIGS. 9 and 10, reference numeral 1 denotes an adhesive; 2, a heat sink; 3, a jetting element; 4, a nozzle; 5, a manifold; 6, an ink chamber; 7, an energy generating body; 8, a wiring board; 9, a bonding wire; and 10, a sealant.

The jetting element 3 has a plurality of nozzles 4 formed, the nozzles being opened outside. The plurality of nozzles 4 internally communicate with the ink chamber 6. Along the plurality of nozzles 4 extend energy generating bodies 7, respectively. The energy generating body 7 produces air bubbles within each corresponding nozzle, and it is the pressure of the produced air bubbles that jet ink droplets out of the openings of the nozzles 4 to make a recording.

The jetting element 3 is arranged in the heat sink 2, and the heat sink 2 releases the heat generated by the energy generating bodies 7. Further, the wiring board 8 is arranged in the heat sink 2. The wiring board 8 not only transmits power and signals supplied from the recording apparatus main body through the bonding wire 9, but also transmits signals of various sensors arranged in the jetting element 3 and the like to the recording apparatus main body.

The manifold 5 has a communication path for supplying the ink introduced from the not shown ink tank to the jetting element 3. The manifold 5 is bonded with the jetting element 3 so that the opening of the communication path communicates with the opening of the ink chamber 6 of the jetting element 3.

This ink jet recording head is manufactured by first preparing the jetting element 3 while bonding a first board and a second board together. The first board has the plurality of nozzles 4 and the ink chamber 6 communicating with the nozzles 4 formed therein, and the second board has the energy generating bodies 7 for jetting ink droplets formed so as to correspond to the nozzles 4. For bonding these two boards together, a low-molecular epoxy resin-containing adhesive such as disclosed in Unexamined Japanese Patent Publication No. Hei. 6-344555 and the like can be used.

Then, by fixing the jetting element 3 to one end of the heat sink 2 that is the base member having the wiring board 8 arranged, the jetting element 3 and the wiring board 8 are electrically connected through the bonding wire 9. Further, the adhesive 1 is applied to a bonded surface between the jetting element 3 and the manifold 5 and to the manifold 5 corresponding to such bonded surface so that the ink will not leak therefrom. That a watertight seal is arranged on this bonded portion is disclosed in Unexamined Japanese Patent Publication No. Hei. 6-8419 and the like, and the use of an adhesive is referred to in Unexamined Japanese Patent Publication No. Hei. 5-147226 and the like. Further, Unexamined Japanese Patent Publication No. Hei. 6-210855 discloses the use of silicone rubber as a sealant. These publications propose to use adhesives and the like for bonding the flow path forming members from the viewpoint of improving sealability of the ink flow path and preventing leakage of ink.

When the adhesive 1 is applied thinly, nonuniform thicknesses tend to result. If the adhesive is applied inadequately to a portion, the ink may leak from such portion, whereas if the adhesive is applied too much to a portion, the adhesive exudes over the ink flow path to narrow the flow path. For overcoming this problem, the adhesive 1 is applied to a certain thickness so that negative effects arising from nonuniform thicknesses can be reduced.

In addition, for protecting the bonding wire 9 as well as reinforcing the bonding of the jetting element 3 with the manifold 5, the sealant 10 is charged into a space enclosed by a surface, the manifold 5, and the heat sink 2, the surface being opposite to the surface of the jetting element 3 having the openings of the nozzles 4. As proposed in, e.g., Unexamined Japanese Patent Publication No. Hei. 5-293964, it is known to use a room temperature curing silicone resin as the sealant 10. The room temperature curing silicone resin exhibits excellent ink sealability, and cures in the form of rubber so that breakage of the members due to thermal shock can be prevented.

In the thus prepared ink jet recording head the ink is supplied from the not shown ink tank. The ink supplied from the ink tank passes through the communication path of the manifold 5, supplied to the ink chamber 6 of the jetting element 3, and further supplied to the respective nozzles 4. Since the openings of the respective nozzles 4 are exposed to the atmosphere, the ink leaks from the openings of the nozzles 4 unless some measure is taken. Thus, as one measure, the internal pressure of the ink flow path is always held at $-30\ mmH_2O$ to $-130\ mmH_2O$ by an ink-impregnated member within the ink tank and a negative pressure generating mechanism.

When the ink jet recording head constructed as described above is left inoperative for several days, air bubbles are produced inside the manifold 5 and grow so as to close the flow path, blocking the supply of ink. As a result, defective printing has often occurred.

FIG. 11 is a diagram illustrative of the problem encountered by the conventional ink jet recording head. Reference numeral 11 denotes an air bubble. The construction shown in FIG. 11 is similar to that shown in FIG. 10. The adhesive 1 used to bond the manifold 5 with the jetting element 3 forms part of the ink flow path by itself. That is, an ink flow path portion whose cross section is indicated by crosses in FIG. 11 out of the ink flow path is all enclosed by the adhesive 1, and this may be considered equivalent to the ink flow path being formed of the adhesive 1. The adhesive 1 is applied to a certain thickness as described above. Hence, the ink flow path formed of the adhesive 1 has a length that is not negligible.

Causes of air bubbles produced within the manifold 5 were studied thoroughly. From the study it is found out that in the ink jet recording head with the interior of the ink flow path always held at a negative pressure, air bubbles were produced by permeation of air through the adhesive 1 used to bond the jetting element 3 with the manifold 5 as shown in FIG. 11. The air bubble 11 is produced by permeation of air, and the air bubble 11 narrow or clog the ink flow path to block the supply of the ink and hence frequently cause defective printing.

How a gas permeates will be described in detail. FIG. 12 is a schematic diagram of a gas permeation system. In a system of a gas a and a gas b partitioned by the adhesive 1, the pressure of the gas a is higher than the pressure of the gas b. Hence, there is a difference in pressure between the gas a and the gas b. That is, in a "gas-adhesive-gas" system, and if there is a difference in pressure in such system, it is known that a gas permeates even if the difference in pressure is very small and even if the quantity of the gas of lower pressure is very small. Incidentally, in a "gas-adhesive-liquid" system, the gas does not permeate even if the pressure of the liquid is lower than the pressure of the gas.

That is, in the ink jet recording head in which the internal pressure of the ink flow path is always set to a smaller value than the atmospheric pressure, the air bubble within the manifold comes in contact with the adhesive. When a "gas-adhesive-gas" system is formed, gas permeation occurs to allow the gas to enter into the ink flow path. In addition, in gas permeation the larger the area in which the air bubble comes in contact with the adhesive, the larger the quantity of gas that permeates. Since the area in which the air bubble is in contact with the adhesive can be reduced by making the thickness of the adhesive layer thin, the quantity of gas that permeates can be reduced. However, one must keep in mind that a certain thickness must be given to reduce the negative effects brought about by the nonuniformity in thickness as described above.

On the contrary, even if the gas permeabilities are the same, an adhesive to which air bubbles are harder to adhere is harder to form a "gas-adhesive-gas" system. It can therefore be said that such adhesive permeates smaller quantities of gas. Unexamined Japanese Patent Publication No. Hei. 6-134987 discloses the fact that the possibility that air bubbles will adhere to the inner wall of the flow path can be excluded by improving the wettability of the ink flow path of the recording head with respect to the ink. However, for applying this technique to the end face of the adhesive, a wettability improving process must be performed after the assembling of the parts, and such process is extremely difficult to perform.

SUMMARY OF THE INVENTION

The object of the invention is to provide an ink jet recording head that can always provide satisfactory print image without producing air bubbles within the ink flow path even if the ink jet recording head is left inoperative for a long period of time.

To achieve the above object, the invention as recited in aspect 1 is applied to an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. In such ink jet recording head, an internal pressure within an ink flow path from the ink containing member to the nozzles is held at a value smaller than the atmospheric pressure; at least part of the respective members forming the ink flow path are bonded together using an adhesive; the adhesive forms the part of the ink flow path; and a gas permeability of the adhesive is smaller than $2.0\times10^{-6}$ $cm^3\cdot cm/cm^2\cdot sec\cdot atm$. As recited in aspect 2, the invention may be applied to an ink jet recording head in which the jetting element member and the ink flow path member are bonded together using the adhesive; the bonded portion created by the adhesive forms the part of the ink flow path; and a gas permeability of the adhesive is $2.0\times10^{-7}$ $cm^3\cdot cm/cm^2\cdot sec\cdot atm$ or less.

The invention as recited in aspect 3 is applied to a method of manufacturing an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. Such method involves the step of bonding at least part of the respective members forming an ink flow path from the ink containing member to the nozzles using an adhesive whose gas permeability is smaller than $2.0\times10^{-6}$ $cm^3\cdot cm/cm^2\cdot sec\cdot atm$, so that the adhesive forms the part of the ink flow path from the ink containing member to the nozzles, the part of the ink flow path having an internal pressure held at a value smaller than the atmospheric pressure.

The invention as recited in aspect 4 is applied to an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. In such ink jet recording head, an internal pressure within an ink flow path from the ink containing member to the nozzles is held at a value lower than the atmospheric pressure; at least part of the respective members forming the ink flow path are bonded together using an adhesive; the adhesive forms the part of the ink flow path; and an angle of contact of the adhesive with respect to the ink is set to 45° or less.

The invention as recited in aspect 5 is applied to a method of manufacturing an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. Such method involves the step of bonding at least part of the respective members forming an ink flow path from the ink containing member to the nozzles using an adhesive whose angle of contact with respect to the ink is 45°, so that the adhesive forms the part of the ink flow path from the ink containing member to the nozzles, the part of the ink flow path having an internal pressure held at a value smaller than the atmospheric pressure.

The invention as recited in aspect 6 is applied to an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. In such ink jet recording head, an internal pressure within an ink flow path from the ink containing member to the nozzles is held at a value smaller than the atmospheric pressure; at least part of the respective members forming the ink flow path are bonded together using an adhesive; the adhesive forms the part of the ink flow path; and the ink flow path is smoothly shaped at a bonded portion created by the adhesive.

The invention as recited in aspect 7 is applied to a method of manufacturing an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. Such method involves the steps of: bonding at least part of the respective members forming an ink flow path from the ink containing member to the nozzles using an adhesive, so that the adhesive forms the part of the ink flow path from the ink containing member to the nozzles, the part of the ink flow path having an internal pressure held at a value smaller than the atmospheric pressure; and shaping the ink flow path smoothly at a bonded portion created by the adhesive.

The invention as recited in aspect 8 is applied to an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. In such ink jet recording head, an internal pressure within an ink flow path from the ink containing member to the nozzles is held at a value smaller than the atmospheric pressure; at least part of the respective members forming the ink flow path are bonded together using an adhesive; the adhesive forms the part of the ink flow path; and a wettability of the adhesive with respect to the ink is equal to or greater than a wettability of the ink flow path member with respect to the ink.

The invention as recited in aspect 9 is applied to a method of manufacturing an ink jet recording head having a jetting element member, an ink flow path member, and an ink containing member, the jetting element member having a plurality of nozzles, an energy generating body for jetting ink droplets out of the nozzles, and an ink chamber communicating with the nozzles, the ink flow path member supplying an ink to the jetting element member. Such method involves the step of bonding at least part of the respective members forming an ink flow path from the ink containing member to the nozzles using an adhesive whose wettability with respect to the ink is equal to or greater than a wettability of the ink flow path member with respect to the ink, so that the adhesive forms the part of the ink flow path from the ink containing member to the nozzles, the part of the ink flow path having an internal pressure held at a value smaller than the atmospheric pressure.

The invention as recited in aspect 1 or 3 is characterized as using an adhesive whose gas permeability is smaller than $2.0\times10^{-6}$ $cm^3\cdot cm/cm^2\cdot sec\cdot atm$ as the adhesive for forming part of the ink flow path. Therefore, even if a "gas-adhesive-gas" system is formed with air bubbles having adhered to the adhesive, the entering of the gas into the ink flow path can be reduced. As a result, even if the ink jet recording head has been left inoperative for a long period of time, the production of air bubbles in the ink flow path is reduced, thereby allowing satisfactory print image to be obtained. It is particularly effective to use an adhesive whose gas permeability is $2.0\times10^{-7}$ $cm^3\cdot cm/cm^2\cdot sec\cdot atm$ or less at the bonded portion between the jetting element and the ink flow path forming member as recited in aspect 2.

The invention as recited in aspect 4 or 5 is characterized as using an adhesive whose angle of contact with respect to the ink is 45° as the adhesive for forming the ink flow path. Therefore, air bubbles are hard to adhere to the adhesive. As a result, a "gas-adhesive-gas" system is hard to form, which in turn contributes to reducing the entering of the gas into the ink flow path. Hence, even if the ink jet recording head has been left inoperative for a long period of time, the production of air bubbles in the ink flow path is reduced, thereby allowing satisfactory print image to be obtained.

The invention as recited in aspect 6 or 7 is characterized as shaping the ink flow path smoothly at the bonded portion created by the adhesive. Therefore, air bubbles are hard to adhere to the adhesive. As a result, a "gas-adhesive-gas" system is hard to form, which in turn contributes to reducing the entering of the gas into the ink flow path. Hence, even if the ink jet recording head has been left inoperative for a long period of time, the production of air bubbles in the ink flow path is reduced, thereby allowing satisfactory print image to be obtained.

The invention as recited in aspect 8 or 9 is characterized as using an adhesive whose wettability with respect to the ink is equal to or greater than the wettability of the ink flow path forming member with respect to the ink as the adhesive for forming the ink flow path. Therefore, the surface to which the adhesive has been applied is always wetted by the ink, which in turn makes a "gas-adhesive-gas" system hard to form. As a result, the entering of the gas into the ink flow path can be reduced. Hence, even if the ink jet recording head has been left inoperative for a long period of time, the production of air bubbles in the ink flow path is reduced, thereby allowing satisfactory print image to be obtained.

BRIEF DESCRIPTION OF THE DRAWINGS

FIG. 3 is a diagram illustrative of a relationship between the gas permeability of an adhesive and the number of defective heads.

FIG. 4 is a diagram illustrative of a relationship between the angle of contact and the quantity of bubbles that adhered.

FIGS. 5A and 5B are diagrams illustrative of a difference in the adhesion of bubbles due to a difference in the shape in the vicinity of a bonded portion between the jetting element and the manifold in the ink jet recording head.

FIG. 6 is a diagram illustrative of a relationship between the shape in the vicinity of the bonded portion and the number of defective heads.

FIG. 7 is a partially enlarged sectional views showing bonded portions between the jetting element and the manifold in a third embodiment of the invention.

FIG. 8 is a diagram illustrative of a relationship between various conditions and the number of defective heads.

FIG. 9 is a perspective view of an exemplary conventional ink jet recording head in the vicinity of a jetting element and a manifold.

FIG. 10 is a sectional view taken along a plane A of the exemplary conventional ink jet recording head in the vicinity of the jetting element and the manifold.

FIG. 11 is a diagram illustrative of problems in the conventional ink jet recording head.

FIG. 12 is a schematic diagram showing a gas permeation system.

DETAILED DESCRIPTION OF THE PREFERRED EMBODIMENTS

Figure 1:
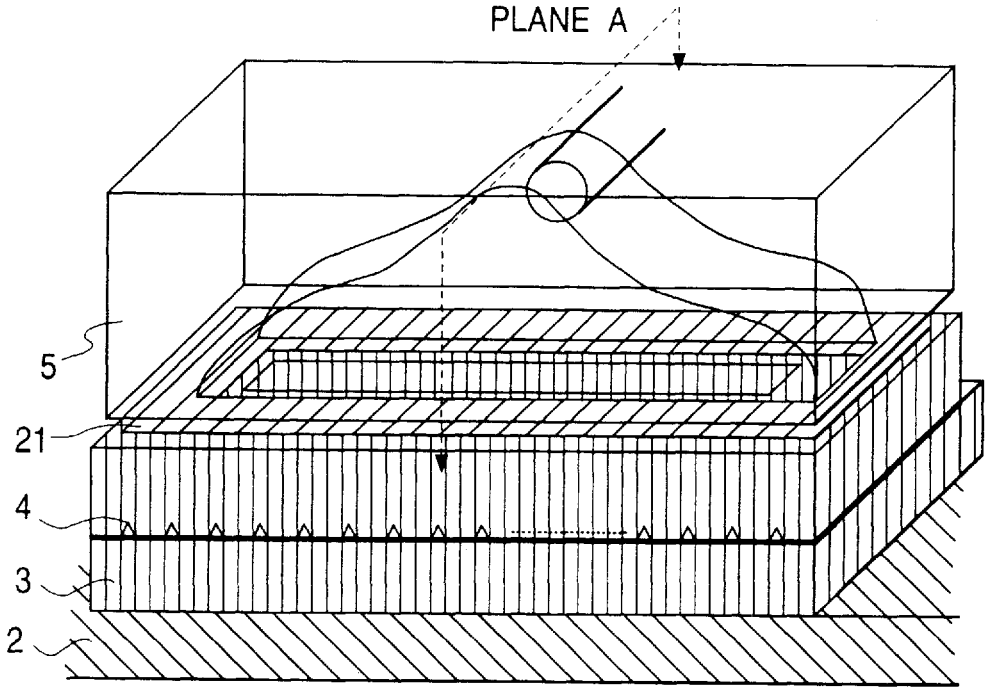
FIG. 1 is a perspective view of an ink jet recording head, which is a first embodiment of the invention, in the vicinity of a jetting element and a manifold.
Figure 2:
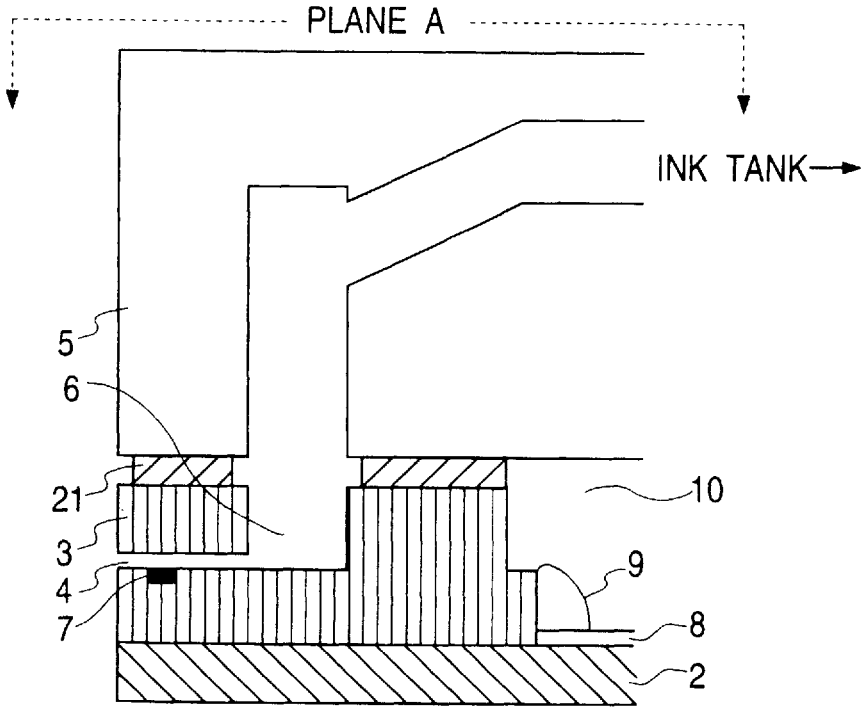
FIG. 2 is a sectional view taken along a plane A of the ink jet recording head, which is the first embodiment of the invention, in the vicinity of the jetting element and the manifold.

FIG. 1 is a perspective view of an ink jet recording head, which is a first embodiment of the invention, in the vicinity of a jetting element and a manifold. FIG. 2 is a sectional view taken along a plane A of the ink jet recording head shown in FIG. 1. In FIGS. 1 and 2, the same parts and components as those in FIG. 9 are denoted as the same reference numerals, and the descriptions thereof will be omitted. Reference numeral 21 denotes an adhesive. Similarly to the constructions shown in FIGS. 9 and 10, the jetting element 3 has a plurality of nozzles 4, energy generating bodies for jetting not shown ink droplets, and an ink chamber communicating with the nozzles 4. For example, a total of 128 nozzles 4 may be arranged to implement 360 dpi. The nozzle driving frequency may be set to about 4.0 kHz. The nozzle arrangement and nozzle driving frequency are not limited by the aforementioned values; the magnitude of dpi, the number of nozzles, and the drive frequency may, of course, be increased or decreased. An electrical heat converting body may be used as the energy generating body. Electricity is utilized as the energy for jetting ink droplets.

In this embodiment the manifold that is the anterior chamber for supplying the ink to the jetting element 3 is bonded with the jetting element 3 using the adhesive 21. The ink is supplied to the jetting element 3 via the manifold 5 through a communication path from a not shown ink tank. The adhesive 21 used in this embodiment may preferably have a gas permeability smaller than $2\times10^{-6}$ $cm^3\cdot cm/cm^2\cdot sec\cdot atm$. A more preferable gas permeability is $2\times10^{-7}$ $cm^3\cdot cm/cm^2\cdot sec\cdot atm$ or less.

Effects that the gas permeability of the adhesive 21 exerts on the ink jet recording head will be described. FIG. 3 is a diagram illustrative of a relationship between the gas permeability of the adhesive and the number of defective heads. For an analysis of the correlation between the gas permeability of the adhesive and defective printing, a total of four samples of the adhesive 21 shown in FIG. 1 were prepared, the four sample adhesives having the following gas permeabilities.

$2\times10^{-5}$ $cm^3\cdot cm/cm^2\cdot sec\cdot atm$ $2\times10^{-6}$ $cm^3\cdot cm/cm^2\cdot sec\cdot atm$ $2\times10^{-7}$ $cm^3\cdot cm/cm^2\cdot sec\cdot atm$ $2\times10^{-8}$ $cm^3\cdot cm/cm^2\cdot sec\cdot atm$ A total of ten ink jet recording heads were manufactured for each of the aforementioned four types of adhesives by the same manufacturing method as the conventional method. Ink was charged to these heads. The heads were left inoperative for a week and for a month, and thereafter subjected to a printing evaluation test. The result of the test is shown in FIG. 3.

It is understood from FIG. 3 that the smaller than $2\times10^{-6}$ $cm^3\cdot cm/cm^2\cdot sec\cdot atm$ the gas permeability of the adhesive is, the less the defective printing occurs. With a gas permeability of $2\times10^{-7}$ $cm^3\cdot cm/cm^2\cdot sec\cdot atm$ or less in particular, no defective printing occurs even after the heads were left inoperative for a month. This fact indicates that as long as the gas permeability of the adhesive is smaller than $2\times10^{-6}$ $cm^3\cdot cm/cm^2\cdot sec\cdot atm$, or more preferably is $2\times10^{-7}$ $cm^3\cdot cm/cm^2\cdot sec\cdot atm$ or less, the entering of the gas into the ink flow path can be reduced and occurrence of defective printing can therefore be controlled. Incidentally, the gas permeabilities of low-temperature curing silicon-containing adhesives heretofore been used are $2\times10^{-6}$ $cm^3\cdot cm/cm^2\cdot sec\cdot atm$ or more. It is low-temperature curing epoxy-containing adhesives that may be used as the adhesive whose gas permeability is $2\times10^{-7}$ $cm^3\cdot cm/cm^2\cdot sec\cdot atm$ or less. Further, the gas permeability of rubber-containing adhesive is, in general, about 1/10 to 1/20 of that of silicone rubbers, and these rubber-containing adhesives may also be usable.

Further, a total of twenty ink jet recording heads using a low-temperature curing epoxy-containing adhesive whose gas permeability is $2\times10^{-7}$ $cm^3\cdot cm/cm^2\cdot sec\cdot atm$ as the adhesive 21 used to bond the jetting element 4 with the manifold 5 of the ink jet recording head were also prepared separately. While an examination on how much gas permeated was made and a printing evaluation test was carried out on these ink jet recording heads, no defective printing was reported, nor was any gas produced within the ink flow path.

A method of manufacturing the ink jet recording head, which is the first embodiment of the invention, will be described. The ink jet recording head presented as the first embodiment is manufactured by substantially the same method as the conventional manufacturing method. How the jetting element 3 is bonded with the manifold 5 will be described.

First, an appropriate quantity of adhesive 21 is charged into a syringe, and then the adhesive 21 is degassed by a centrifugal separator. As a specific example of the adhesive 21, a liquid thermosetting epoxy-containing adhesive (the epoxy resin is of bisphenol F type and the latent curing agent is of the imidazole type) may be used. A filler formed by mixing alumina and silica can be used. The viscosity before curing is 1500000 mPas, the curing condition is 150° C.×30 minutes.

A needle is attached to the syringe containing the degassed adhesive 21 therein, and then the syringe is set to a triaxially controlled robot having a dispenser 3. By controlling the dispenser and the robot, a predetermined quantity of the adhesive is applied to a predetermined position of the jetting element 3. A specific area of application is about 250 to 350 $\mu$m×120 to 170 $\mu$m.

After the adhesive 21 has been applied, the manifold 5 is mounted on the jetting element 3, and a flow path is formed by interposing the adhesive 21 between the manifold 5 and the jetting element 3. During the formation of the flow path, the adhesive 21 is applied to a thickness ranging from about 50 to 100 $\mu$m, specifically. The thus assembled body is directly heated in an oven to cure the adhesive 21.

The jetting element 3 can be bonded with the manifold 5 in this way. Even in the case where the aforementioned epoxy-containing adhesive is used, not only excellent sealability was obtained, but also parts were not broken due to thermal shock during the curing similarly to the case where the conventional silicon-containing adhesive was used. The aforementioned adhesive application method is merely an example; other application methods may also be employed. Moreover, instead of applying the adhesive 21 to the jetting element 3, the adhesive may be applied to the manifold 5.

An ink jet recording head, which is a second embodiment of the invention, will be described next. The construction of the second embodiment is the same as that of the first embodiment. The second embodiment is characterized as using the adhesive 21 whose angle of contact with respect to the ink is 45° or less. FIG. 4 is a diagram illustrative of a relationship between the angle of contact and the quantity of bubbles that adhered. In FIG. 4, how bubbles adhere was evaluated by first applying the adhesive over a silicon wafer, then preparing samples of adhesives having different angles of contact with respect to the ink, and immersing such samples into ink. The result of the evaluation is shown in FIG. 4. It is understood from the result shown in FIG. 4 that the bubbles do not adhere as long as the angle of contact of the adhesive with respect to the ink is 45° or less.

The angle of contact of the epoxy-containing adhesive used in the first embodiment with respect to the ink is about 40°, which means that a condition that the angle of contact is 45° or less is satisfied. As a result, air bubbles are hard to adhere to the adhesive 21 within the ink flow path, and therefore the entering of the air bubbles through the adhesive can be reduced. Further, since there is no need for controlling the adhesion of bubbles during the manufacturing process, a cost reduction can be implemented.

Adhesives to be used are not limited to epoxy-containing adhesives, but may be those satisfying the condition that the angle of contact with respect to the ink is 45° or less. For example, an adhesive whose gas permeability is about $2\times10^{-6}$ $cm^3\cdot cm/cm^2\cdot sec\cdot atm$ similarly to the adhesive used in the conventional example can be used if such adhesive has a small angle of contact.

Furthermore, if the wettability of the adhesive 21 is equal to or greater than the wettability of the manifold 5, air bubbles within the ink are easier to adhere to the wall surface of the manifold 5 than to that of the adhesive 21. As a result, by making the wettability of the adhesive 21 equal to or greater than the wettability of the manifold 5, adhesion of air bubbles can be reduced. If one substitutes the wettability for the angle of contact, one may set the angle of contact of the adhesive 21 with respect to the ink to a value equal to or smaller than the angle of contact of the manifold 5 with respect to the ink.

The aforementioned conditions on the angle of contact (including the angle of contact substituting for the wettability) are independent conditions. By using an adhesive having an angle of contact with respect to the ink satisfying the two conditions, adhesion of air bubbles can be reduced more efficiently, and therefore the entering of a gas into the ink flow path can be prevented.

An ink jet recording head, which is a third embodiment of the invention, will be described next. After, e.g., an ink jet recording head whose construction is the same as that of the first embodiment was manufactured, how air bubbles adhered was observed in such ink jet recording head. It was verified from the observation that the air bubbles tended to adhere to the edge portions and asperities of the adhesive. It was thus found out from this fact that smooth bonding is desirable to eliminate air bubbles from the bonded portion in the ink jet recording head.

The shape of the bonded portion created by the adhesive will be described. FIGS. 5A and 5B are diagrams illustrative of a difference in how air bubbles adhere due to a difference in the shape in the vicinity of a portion at which the jetting element and the manifold are bonded together in the ink jet recording head. FIG. 6 is a diagram illustrative of a relationship between the shape in the vicinity of the bonded portion and the number of defective heads. The parts and components in FIGS. 5A, 5B, and 6 are denoted as the same reference numerals as those in FIG. 1. FIG. 5A shows a shape similar to that of the conventional example, whereas FIG. 5B shows a shape characterized as having a recess formed on a surface of the adhesive 21 by first bringing the manifold 5 closer to the jetting element 3 and then moving the manifold 5 away from the jetting element 3 at the time of assembling the manifold 5. A total of ten ink jet recording heads were prepared for each of the two types of heads by the same method as the conventional method using the conventional adhesive. An analysis of the correlation between the shape of the adhesive and defective printing was made in a manner similar to the aforementioned analysis of the gas permeability.

The result such as shown in FIG. 6 is obtained. The shape a is as shown in FIG. 5A, and the shape b is as shown in FIG. 5B. As is apparent from this result, defective printing results less from the smoothly bonded portion having only small steps.

FIG. 7 shows bonded portions between the jetting element and the manifold in the third embodiment of the invention in partially enlarged sectional views. The parts and components in FIG. 7 are denoted as the same reference numerals as those in FIG. 1. In FIG. 7, end portions of the ink flow path formed in the manifold 5 are chamfered, and have sloped surfaces whose width is about 200 $\mu$m. The adhesive 21 is applied as far as to such sloped surfaces and solidified. In the construction shown in FIG. 7, there is no such grooved clearance as observed in FIG. 5A, nor are right-angled or acute-angled projections present at the bonded portions except for the entrance of the ink chamber 6 of the jetting element 3. As a result of this construction, the ink flow path becomes smooth at the bonded portion to which the adhesive 21 has been applied, and hence adhesion of air bubbles can be reduced at the bonded portion.

FIG. 8 is a diagram illustrative of a relationship between various conditions and the number of defective heads. A total of ten ink jet recording heads were prepared for each of the various conditions indicated in the first to the third embodiment. These ink jet recording heads were left inoperative for a day, a week, and a month after charging ink, and the number of defective heads was thereafter checked. The ink jet recording heads under examination include those having gas permeabilities of $2\times10^{-5}$ $cm^3\cdot cm/cm^2\cdot sec\cdot atm$ and $2\times10^{-6}$ $cm^3\cdot cm/cm^2\cdot sec\cdot atm$, those having angles of contact of 60° and 40°, and those having the shapes shown in FIGS. 5A and 5B.

As mentioned with reference to the first embodiment, the heads using adhesives whose gas permeability is smaller than $2\times10^{-6}$ $cm^3\cdot cm/cm^2\cdot sec\cdot atm$ could prevent the entering of a gas into the ink flow path. That is, the condition that the gas permeability is smaller than $2\times10^{-6}$ $cm^3\cdot cm/cm^2\cdot sec\cdot atm$ alone is contributory to preventing the entering of a gas into the ink flow path. However, even in the case where an adhesive having a gas permeability exceeding about $2\times10^{-6}$ $cm^3\cdot cm/cm^2\cdot sec\cdot atm$ was used, it was also found out that the entering of a gas could be controlled if other conditions were different. That is, in FIG. 8, when the conditions that the gas permeability is $2\times10^{-6}$ $cm^3\cdot cm/cm^2\cdot sec\cdot atm$; that the angle of contact is 40°; and that the shape is as shown in FIG. 5A, only three ink jet recording heads out of the ten ink jet recording heads had defects after left inoperative for a month. A further reduction in defective printing can be implemented if, e.g., the bonded portion is shaped as shown in FIG. 1.

Further, when an adhesive whose angle of contact with respect to the ink is 40° is used, the number of ink jet recording heads exhibiting defective printing increases mildly although the gas permeabilities and shapes are the same. This attests to the fact that a reduction in the angle of contact contributes to controlling the entering of a gas. Similarly, when the bonded portion is flattened, the number of ink jet recording heads exhibiting defective printing increases mildly, and this attests to the fact that the flat shape of the bonded portion contributes to controlling the entering of a gas.

While the bonded portion between the jetting element and the manifold has been described in particular in the aforementioned description, the entering of a gas can be controlled by selecting the aforementioned adhesives as well as by implementing the aforementioned flow path structure at portions where the adhesive forms part of the ink flow path, e.g., bonded portions between parts forming the manifold.

While liquid ink is employed in the above description, not only solid ink at room temperature but also soft ink at room temperature can be used in the invention.

As is apparent from the foregoing, the invention can provide the advantage of not only manufacturing an ink jet recording head that can provide satisfactory print image without producing air bubbles within the ink flow path even if the ink jet recording head is left inoperative for a long period of time, but also improving the reliability of the ink jet recording head and increasing the yield in the respective manufacturing process steps by using an adhesive whose gas permeability is smaller than $2\times10^{-6}$ $cm^3 \cdot cm/cm^2 \cdot sec \cdot atm$. Moreover, the invention can provide the advantage of controlling the entering of air through the adhesive and similar advantages by making the air bubbles hard to adhere to the adhesive while setting the angle of contact of the adhesive with respect to the ink to 45° or less, or by making the wettability of the adhesive equal to or greater than the wettability of the ink flow path forming member, or by shaping the bonded portion in the ink flow path to be as flat as possible.

What is claimed is:

1. An ink jet recording head comprising:

a jetting element member having a plurality of nozzles;

an energy generating body for jetting ink droplets out of said nozzles; and an ink chamber communicating with said nozzles;

an ink flow path member supplying an ink to said ink jetting element member, wherein end portions of the ink flow path member are chamfered and have sloped surfaces; and an ink containing member, wherein an internal pressure within an ink flow path from said ink containing member to said nozzles is held at a value smaller than the atmospheric pressure;

at least part of said ink flow path member and said jetting element member are bonded by an adhesive, wherein said adhesive extends to said end portions having sloped surfaces and forms a part of said ink flow path, and said ink flow path is smoothly shaped at a portion bonded by said adhesive.

2. The ink jet recording head of claim 1, wherein a width of said sloped surfaces is substantially 200 $\mu$m.

3. The ink jet recording head of claim 1, wherein said adhesive is a type of low-temperature curing epoxy-containing adhesive.

4. The ink jet recording head of claim 1, wherein a gas permeability of said adhesive is smaller than $2.0\times10^{-6}$ $cm^3$ $cm/cm^2$ sec atm.

5. A method of manufacturing an ink jet recording head comprising:

a jetting element member having a plurality of nozzles, an energy generating body for jetting ink droplets out of said nozzles; and an ink chamber communicating with said nozzles;

an ink flow path member supplying an ink to said jetting element member, wherein end portions of the ink flow path member are chamfered and have sloped surfaces; and an ink containing member, comprising the steps of:

bonding at least part of said ink flow path member and said jetting element member by an adhesive, wherein said adhesive extends to said end portions having sloped surfaces to form part of an ink flow path from said ink containing member to said nozzles, a part of said ink flow path having an internal pressure held at a value smaller than the atmospheric pressure; and shaping said ink flow path smoothly at a portion bonded by said adhesive.

6. The method of manufacturing an ink jet recording head of claim 5, wherein a width of said sloped surfaces is substantially 200 $\mu$m.

7. The method of manufacturing an ink jet recording head of claim 5, wherein said adhesive is a type of low-temperature curing epoxy containing adhesive.

8. The method of manufacturing an ink jet recording head of claim 5, wherein gas permeability of said adhesive is smaller than $2.0\times10^{-6}$ $cm^3$ $cm/cm^2$ atm.

* * * * *